US005240660A

United States Patent [19]

Marshall

[11] Patent Number: 5,240,660

[45] Date of Patent: Aug. 31, 1993

[54] ABRASION RESISTANT POLYESTER YARN AND CORDAGE

[75] Inventor: Robert M. Marshall, Chesterfield, Va.

[73] Assignee: Alllied-Signal Inc., Morris Township, Morris County, N.J.

[21] Appl. No.: 701,919

[22] Filed: May 17, 1991

[51] Int. Cl.[5] ..... D01F 11/04; D02G 3/00

[52] U.S. Cl. ..... 264/103; 264/136; 264/211.14; 427/387; 427/393.4; 427/434.6

[58] Field of Search ..... 264/103, 136, 211.14; 427/387, 393.4, 434.6

[56] References Cited

U.S. PATENT DOCUMENTS 4,211,815 7/1980 Deiner ..... 427/387 X 4,767,646 8/1988 Cordova et al. ..... 427/387

*Primary Examiner*—Leo B. Tentoni

*Attorney, Agent, or Firm*—William H. Thrower

[57] ABSTRACT

A method of producing abrasion resistant cordage from polyester yarn requires treating the yarn after drawing with an aqueous overfinish composition that contains an oxidized polyethylene emulsified with a quaternary amine cationic emulsifying agent and a siloxane compound of the comonomers dimethyl and 3-((2-aminoethyl)aminopropyl) in an effective amount to apply a sufficient level of each of the components to the treated yarn to provide enhanced wet and dry abrasion resistance to the resulting cordage; then forming cordage from the treated yarn.

2 Claims, No Drawings

ABRASION RESISTANT POLYESTER YARN AND CORDAGE

BACKGROUND OF THE INVENTION

1. Field of the Invention

The present invention relates to aqueous overfinish compositions, yarns treated therewith and a method of producing abrasion resistant cordage from the yarn. More specifically, the present invention relates to aqueous overfinishes for application to polyester yarns to improve wet and dry abrasion resistance as well as that of cordage made from the yarn.

2. Description of related art

Cordage products designed for prolonged contact with water need to have wet abrasion resistance. This invention is directed to enhancing wet and dry abrasion resistance for cordage made from polyester fibers. The general term yarn is used herein to include mono- and multifilaments, fiber, thread, yarn or other similar forms. Preferred are continuous filaments.

U.S. Pat. No. 4,767,646 to Cordova et al. discloses enhanced wet abrasion resistance for polyester cordage utilizing an aqueous overfinish comprising the siloxane of the instant invention together with an oxidized polyethylene emulsified with a non-nitrogen emulsifier and neutralized with an alkali hydroxide. U.S. Pat. No. 4,960,431 to Cordova et al. discloses enhanced wet abrasion resistance for cordage comprising treating the yarn with an overfinish composition consisting essentially of an oxidized polyethylene neutralized with ammonium hydroxide and emulsified with a non-nitrogen nonionic emulsifier. While an effective method, particularly for nylon cordage, the resulting ammonia fumes must be substantially contained and vented to avoid any operator discomfort.

SUMMARY OF THE INVENTION

In accordance with the invention, there is provided a method of producing abrasion resistant cordage from polyester yarn comprising:

treating the yarn after drawing with an aqueous overfinish composition comprising an oxidized polyethylene emulsified with a quaternary amine cationic emulsifying agent and a siloxane compound of the comonomers dimethyl and 3-[(2-aminoethyl)aminopropyl] in an effective amount to apply a sufficient level of each of said components to the treated yarn to provide enhanced wet and dry abrasion resistance to the resulting cordage;

then forming cordage from the treated yarn.

DESCRIPTION OF THE PREFERRED EMBODIMENT

The invention is directed specifically to the production of cordage having enhanced wet and dry abrasion resistance from polyester yarn.

The preferred polyesters are the linear terephthalate polyesters, i.e., polyesters of a glycol containing from 2 to 20 carbon atoms and a dicarboxylic acid component containing at least about 75 percent, more preferably 90 percent terephthalic acid. The remainder, if any, of the dicarboxylic acid component may be any suitable dicarboxylic acid such as sebacic acid, adipic acid, isophthalic acid, sulfonyl-4,4'dibenzoic acid, 2,8-dibenzofuran-dicarboxylic acid, or 2,6-naphthalene dicarboxylic acid. The glycols may contain more than two carbon atoms in the chain, e.g., diethylene glycol, butylene glycol, decamethylene glycol, and bis-(1,4-hydroxymethyl)cyclohexane. A particularly preferred linear terephthalate polyester is poly(ethylene terephthalate) (PET).

The siloxane of the present invention is commercially available from Henkel Corporation as Repellan 80, a siloxane of the comonomers dimethyl and 3-[(2-aminoethyl)aminopropyl].

The oxidized polyethylenes utilized in the present invention are low molecular weight polyethylene homopolymers which have an average molecular weight of less than about 5000. The average molecular weight is the number average molecular weight determined by vapor phase osmometry using phenetol as solvent. Preferably, the number average molecular weight is about 1000 to 4000 and most preferably about 1500 to 2500. These polyethylenes have preferably been oxidized to an acid number of about 10 to 35, more preferably about 12 to 28 and most preferably about 13 to 17. These oxidized polyethylenes preferably have a softening point as determined by ASTM E-28 of about 85° to 145° C., more preferably about 95° to 140° C. and most preferably about 98° to 115° C. Preferably, such oxidized polyethylenes have a Brookfield viscosity at 140° C. (284° F.) of about 120 to 300 centipoises (hereafter cps) and most preferably about 170 to 250 cps. Such oxidized polyethylenes are commercially available, for example, from Allied Corporation as A-C® polyethylene type 680 and 392, the latter having Brookfield viscosity at 149° C. (300°F.) of 9000 cps.

The oxidized polyethylenes useful in this invention may be obtained by oxidizing low molecular weight polyethylenes with air or oxygen by conventional procedures. See, for example, U.S. Pat. No. 3,060,163 to Erchak, Jr., and U.S. Pat. No. 3,322,711 to Bush et al., as well as Canadian Patent 854,778.

Any suitable quaternary amine cationic emulsifying agent may be used in emulsifying the oxidized polyethylenes used in the present invention. Mixtures of higher fatty amines, for example, C6 to C20 aliphatic amines derived from animal or vegetable oils, may be used as emulsifiers. Also useful are the condensation products of ethylene oxide with the amines. These products are characterized by containing as the hydrophilic portion of the molecule, a plurality of oxyethylene moieties as illustrated in the formula $$R—O—(CH_2—CH_2)_X—CH_2—CH_2OH$$

wherein R is an alkyl amine group having from 6 to 20 carbon atoms and X is 5–40, preferably 10–30.

In the aqueous overfinish composition, it is not necessary that the oxidized polyethylene and the siloxane be present in equal amounts, but they should be present in the overfinish in an amount sufficient to conveniently apply an effective amount of each onto the yarn to obtain the benefical results discussed. It is preferred to apply at least 0.1 weight percent of each on the yarn, more preferably 0.15 to 0.5 weight percent, based on weight of the yarn.

The preferred embodiment of this invention may be briefly stated as treating a polyester yarn, particularly continuous multifilament polyester yarn to be processed into industrial cord, with an aqueous overfinish comprising an oxidized polyethylene emulsified with a quaternary amine cationic emulsifying agent and a siloxane compound of the comonomers dimethyl and 3-[(2-aminoethyl)aminopropyl] in an effective amount to apply a sufficient level of each of said components to the treated yarn to provide enhanced wet and dry abrasion resistance to the resulting cordage; then forming cordage from the treated yarn.

The oxidized polyethylene wax as described may be emulsified in water by known methods using any suitable emulsifying agent as set forth above. Reference may be had to U.S. Pat. No. 3,850,658 to Gomez et al. and U.S. Pat. No. 4,371,658 to Marshall et al., for methods of preparing aqueous emulsions of the oxidized polyethylenes.

In the examples, the commercially available polyethylene emulsions are diluted with water followed by blending with the other commercially available emulsions, all at room temperature, to achieve the desired percent solids. Concentrations of between 2 and 40 percent solids are suitable, and between about 5 and 15 percent are preferred.

The finish is applied to the yarn in any of the conventional manners. A satisfactory way of applying the finish components is by feeding a blend of emulsions containing the finish components to a trough equipped with a rotatable roll dipping therein; the yarn contacts this roll at a relative speed with respect to the rate of rotation of the roll adjusted to provide the desired pick up coating by the yarn, for example, between about 3 and 8 percent pickup of the liquid coating by weight based on the weight of the yarn.

The quantities of solids on yarn desired, i.e. between about 0.2 and 1 percent by weight of the finished yarn, is sufficiently large and the solids need to be put on in an overfinish rather than spin finish.

The tests for yarn to yarn dry abrasion, yarn to yarn wet abrasion and yarn to metal wet abrasion are set forth as follows:

1. YARN TO YARN (Y/Y) DRY ABRASION TEST

With reference to FIG. 1 of U.S. Pat. No. 4,960,431, incorporated herein by reference, a one meter length of yarn 10 is tied eccentrically at one end to a cycling wheel 9. Its other end is passed over a first free-wheeling yarn guide 11 and under a pulley 12, thence over a second free-wheeling yarn guide 13, under a cut off device 14 and finally over a third free-wheeling yarn guide 15. At its extreme, a pretension weight 16 is tied onto the yarn. The yarn is looped prior to its being placed around pulley 12 to create twist point 17. The cycling wheel 9 is turned on to rotate clockwise; the yarn alternately is pulled toward the cycling wheel 9 and towards the weight 16 to exert an abrading action on the yarn itself at the point of twist 17 above the pulley 12. The results are reported in cycles to break; the larger the number, the better the dry abrasion resistance.

2. YARN TO YARN (Y/Y) WET ABRASION TEST

This test is identical to the dry abrasion test except that pulley 12 with yarn 10 looped thereabout and twist point 17 are submerged in water in container 18. Results are also reported in cycles to break with the larger numbers being indicative of better wet abrasion resistance.

3. YARN TO METAL (Y/M) WET ABRASION TEST

Breaking strength is measured as taught by ASTM D-885-81 with a 10-inch (25 cm) gage, 12-inch (30 cm) crosshead and 0 chartspeed (no stress strain curve). With reference to FIG. 2 of U.S. Pat. No.4,960,431 a length of yarn 10 (about 1 meter) is taped at one end to the surface of a cycling drum 20. Its other end is passed partially along the circumference of drum 20, through sponge 21, and over a stainless steel hexagonal bar 22 having a diameter of 0.25 inch (0.64 cm). At is extreme, a weight 23 is tied onto yarn 10. Sponge 21, which sits in a canister 24 of water, is partially slit from its top to an aperture (above the top of canister) through which yarn 10 passes. Drum 20 is caused to move back and forth in the direction of yarn travel enough to cause approximately 12 to 14 inches (30–35 cm) of yarn 10 to be dragged back and forth over hexagonal bar 22 2500 times/cycles. As yarn 10 passes through sponge 21 during cycling, it is wettened and wiped. After yarn 10 dries, its breaking strength is again measured in accordance with ASTM D-885-81 above. The breaking strength retention in percent is determined and is set forth as the yarn to metal wet abrasion. This figure is arrived at by taking the difference between the breaking strengths before and after cycling, dividing the difference by the breaking strength before cycling, and multiplying the resulting number by 100.

4. YARN TO METAL (Y/M) DRY ABRASION TEST

The test is identical to the wet abrasion (Y/M) test except that the sponge 21 is removed.

The yarns treated in accordance with this invention are especially adapted for fabrication into ropes of unusually high strength by well known commercial processes. Ropes are prepared from such yarns by a mulistage process, the steps of which may vary depending on the type of rope desired. Example 2 indicates results reported by a commercial rope manufacturer on a 3 strand twisted construction. This data reported correlates well with the yarn data provided in example 1 and shows the validity of such data and its applicability in rope construction.

The following specific examples further illustrate the invention.

EXAMPLE

A 1000 denier PET industrial yarn was overfinished with the listed series of aqueous chemical mixtures in Table 1 below. The resulting treated yarns were evaluated for yarn to yarn abrasion and yarn to metal abrasion. Both tests were conducted under wet and dry conditions. Yarn to Yarn (Y/Y) dry and wet abrasion is reported in cycles to break, average of six samples, with 1500 g pretension weight dry abrasion and 2000 g pretension weight wet abrasion. Yarn to metal (Y/M) wet and dry abrasion is reported in percent breaking strength retained after 2500 cycles at 200 g pretension. Mixtures were prepared in equal parts by weight of the named components, with sufficient water added to facilitate application.

Finish retention is after 1 hour scour. Use 20 g sample of overfinished yarn. Gravimetrically extract with cyclohexane to get level of finish on yarn. Submerge a new 20 g sample in room temperature (about 25° to 30° C.) water with constant stirring for 1 hour. Take out sample and allow to air dry. Do a gravimetrical extraction. Compare the first and second extractions as follows to determine finish retention:

$$\text{Finish Retention (\%)} = 100\% - \left[\left(\frac{\text{1st extraction-2d extraction}}{\text{1st extraction}}\right) \times 100\right]$$

TABLE 1

| Example/ Formulation | % Solids Applied | Y/Y Abrasion Cycles Dry | Y/Y Abrasion Cycles Wet | Y/M Abrasion % B.S. Retained Dry | Y/M Abrasion % B.S. Retained Wet | Finish Retention % |
|---|---|---|---|---|---|---|
| 1./ No Overfinish | — | 4 | 2 | 10 | 0* | — |
| 2./ Repellan 80 Standifin CP | .35 | 452 | 452 | 91 | 72 | 67 |
| 3./ Repellan 80 Discosoft 567 | .41 | 350 | 200 | 65 | 40 | 40 |
| 4./ Repellan 80 | .32 | 250 | 106 | 55 | 46 | 61 |
| 5./ Standifin CP | .25 | 426 | 154 | 71 | 52 | 56 |
| 6./ Repelotex 100 Standifin CP | .42 | 116 | 48 | 20 | 24 | 41 |
| 7./ Chemawax 50S Standifin CP | .55 | 216 | 141 | 66 | 33 | 49 |
| 8./ Repellan 80 Discosoft 881 | .44 | 452 | 430 | 86 | 70 | 65 |

*Yarn broke during test

Chemical descriptions of components in above formulations:

1. Repellan 80 commercially available from Henkel Corporation; 40% active emulsion; a siloxane of the comonomers dimethyl and 3-[(2-aminoethyl)aminopropyl].
2. Standifin CP commercially available from Henkel Corporation; 20% emulsion of AC-680 polyethylene using a diethylsulfate quaternary of cocoamine as emulsifier.
3. Discosoft 567 commercially available from Calloway Chemicals; a 20% emulsion of AC 680 polyethylene using POE(9) octyl phenol (nonionic) as emulsifier.
4. Repelotex 100 commercially available from Rhone-Poulenc; amide/wax melamine copolymer emulsion.
5. Chemawax 50s commercially available from Chematron Chem; a 50% emulsion of paraffin wax.
6. Discosoft 881 commercially available from Calloway Chemcals; a 20% emulsion of AC-680 polyethylene using Ethox TAM 20 DQ as emulsifier [Ethox Chemical, TAM 20 DQ POE (20) Tallow amine, diethyl sulfate quaternary ammonium compound].
7. A-C$^R$ polyethylene 680, commercially available from Allied Corporation; oxidized polyethylene having an acid number of about 16 and a softening point of about 100° C.; neutralized with sodium hydroxide.

EXAMPLE 2

The 1000 denier PET industrial yarn was overfinished with a composition comprising 30 weight percent Standafin CP, 30 weight percent Repellan 80, and 40 weight percent additional water. Level of finish was 0.35 weight percent on weight of yarn. The treated yarn was supplied to an industrial rope manufacturer and was made into 3-strand twisted ropes. The rope product was reported to have improved wet strength that exceeded its dry strength by about 5%, implying that the finish has improved frictional characteristics when wet. Normally wet strength is approximately 50% lower than dry strength. Dry abrasion resistance and wet abrasion resistance were reported to be excellent, showing substantial improvement over a commercial polyethylene finish described in U.S. Pat. No. 3,850,658 to Gomez et al.

What is claimed:

1. A method of producing abrasion resistant cordage from polyester yarn comprising:

treating the yarn after drawing with an aqueous overfinish composition comprising an oxidized polyethylene emulsified with a quaternary amine cationic emulsifying agent and a siloxane compound of the comonomers dimethyl and 3-((2-aminoethyl)-aminopropyl) in an effective amount to apply at least 0.1 weight percent of said oxidized polyethylene and at least 0.1 weight percent of said siloxane compound, each based on weight of the yarn, to the treated yarn to provide enhanced wet and dry abrasion resistance to the resulting cordage;

then forming cordage from the treated yarn.

2. The method of claim 1 wherein 0.15 to 0.5 weight percent of said oxidized polyethylene and 0.15 to 0.5 weight percent of said siloxane compound, each based on weight of the yarn, is applied to the yarn.

* * * * *